US009382668B2

(12) United States Patent
Ibañez Latorre

(10) Patent No.: US 9,382,668 B2
(45) Date of Patent: Jul. 5, 2016

(54) MACHINE AND METHOD FOR RAILWAY TRACK MAINTENANCE, FOR TRACK LEVELLING, ALIGNMENT, COMPACTION AND STABILISATION, CAPABLE OF OPERATING WITHOUT INTERRUPTING THE FORWARD MOVEMENT THEREOF

(71) Applicant: Jose Antonio Ibañez Latorre, Madrid (ES)

(72) Inventor: Jose Antonio Ibañez Latorre, Madrid (ES)

( * ) Notice: Subject to any disclaimer, the term of this patent is extended or adjusted under 35 U.S.C. 154(b) by 0 days.

(21) Appl. No.: 14/360,620

(22) PCT Filed: Nov. 19, 2012

(86) PCT No.: PCT/ES2012/070803

§ 371 (c)(1),
(2) Date: May 25, 2014

(87) PCT Pub. No.: WO2013/076332

PCT Pub. Date: May 30, 2013

(65) Prior Publication Data

US 2014/0318407 A1 Oct. 30, 2014

(30) Foreign Application Priority Data

Nov. 25, 2011 (ES) ..... 201101252

(51) Int. Cl.
*E01B 27/17* (2006.01)
*E01B 29/04* (2006.01)
(Continued)

(52) U.S. Cl.
CPC ..... *E01B 29/04* (2013.01); *E01B 27/023* (2013.01); *E01B 27/17* (2013.01); *E01B 35/00* (2013.01)

(58) Field of Classification Search
CPC ..... E01B 27/00; E01B 27/02; E01B 27/20; E01B 29/00; E01B 29/02; E01B 29/04; E01B 29/05; E01B 29/16; E01B 35/00; E01B 35/02; E01B 35/06
USPC ..... 104/2–5, 7.1–7.3, 10–12
See application file for complete search history.

(56) References Cited

U.S. PATENT DOCUMENTS 3,811,382 A 5/1974 Buchter et al.
3,895,583 A * 7/1975 Theurer ..... E01B 27/17 104/12

(Continued)

FOREIGN PATENT DOCUMENTS

CA 1229018 11/1987
ES 2310843 1/2009

(Continued)

OTHER PUBLICATIONS

International Search Report and the Written Opinion Dated Mar. 5, 2013 From the Oficina Espanola de Patentes y Marcas Re. Application No. PCT/ES2012/070803 and Its Translation Into English.

*Primary Examiner* — R. J. McCarry, Jr.

(57) ABSTRACT

The invention refers to a machine and a method used to level, align and stabilise the track and compact the ballast bed, producing controlled lifting, so that the load used in the settlement of the rail in its theoretical position falls within the established range, working in an uninterrupted manner. The machine is constituted by two bogies with traction capacity, and front, back and centre control cabins and a rear and frontal measuring tensioner trolleys. The machine has an additional lifting unit whose relative movement with the rest of the machine in controlled by total longitudinal cylinder. The alignment cylinders generate a transversal movement to cause track alignment. Behind this unit according to the direction of work a stabilising unit is situated which consists of two stabilising trolleys. The ground-penetrating radar is situated at the machine front.

13 Claims, 10 Drawing Sheets

(51) Int. Cl.
*E01B 35/00* (2006.01)
*E01B 27/02* (2006.01)

(56) References Cited

U.S. PATENT DOCUMENTS

| | | | | |
|---|---|---|---|---|
| 4,323,013 | A | 4/1982 | Theurer | |
| 4,794,862 | A | 1/1989 | Theurer | |
| 5,007,349 | A | 4/1991 | Theurer | |
| 5,052,306 | A | 10/1991 | Theurer et al. | |
| 7,707,944 | B2 * | 5/2010 | Bounds | E01B 27/02 104/5 |
| 2004/0003750 | A1 | 1/2004 | Theurer et al. | |

FOREIGN PATENT DOCUMENTS

| | | |
|---|---|---|
| GB | 2146374 | 4/1985 |
| GB | 2151675 | 7/1985 |
| WO | WO 2006/037416 | 4/2006 |
| WO | WO 2013/076332 | 5/2013 |

* cited by examiner

* h theoretical = absolute profile h+ = additional lifting calculated

MACHINE AND METHOD FOR RAILWAY TRACK MAINTENANCE, FOR TRACK LEVELLING, ALIGNMENT, COMPACTION AND STABILISATION, CAPABLE OF OPERATING WITHOUT INTERRUPTING THE FORWARD MOVEMENT THEREOF

RELATED APPLICATIONS

This application is a National Phase of PCT Patent Application No. PCT/ES2012/070803 having International filing date of Nov. 19, 2012, which claims the benefit of priority of Spain Patent Application No. P201101252 filed on Nov. 25, 2011. The contents of the above applications are all incorporated by reference as if fully set forth herein in their entirety.

OBJECT OF THE INVENTION

The invention at hand refers to both a machine and a method used to level, align and stabilise the track and compact the ballast bed, producing controlled lifting, so that the load used in the settlement of the track in its theoretical position falls within the established range, working in an uninterrupted manner.

TECHNIQUE SECTOR

The invention belongs to the technical sector of railway maintenance, more specifically to that regarding the processes of acquisition, treatment and interpretation of railway geometry data and the application of the same to the rails' levelling, alignment and stabilisation.

CURRENT STATE OF THE TECHNIQUE

The passage of the various vehicles in circulation on the railways, and also their exposure to meteorological conditions, alter the properties of the rails and of the elements upon which they are settled. In order to correct the loss of these properties and to avoid the impossibility of using the rails, a series of types of maintenance work are required. With the technique currently in existence, the process of rail alignment and levelling is undertaken by machines with levelling and alignment units, levelling the sleepers with tamping units. Stabilisation is undertaken by machines equipped with stabilisation units which increase the transversal resistance of the rail. The main patents which detail the elements and methods which are the object of improvement in the present claim are as follows.

Claim AT-PS 345 881 shows a railway maintenance machine described as a mobile rail stabiliser on continuous wheels to compact the ballast bed. This machine is equipped with one or more rail stabilisation units which have an adjustable height and count with rolling tools which allow them to be attached perpendicularly without clearance space and permit longitudinal movement with regard to the rail. By means of two vertical hydraulic actuations joined to the machine's chassis, an adjustable static load is applied to the stabilising unit which subjects the rails to horizontal oscillations with the aid of vibrators. Through the Combination of the static load and the horizontal oscillations, consolidation of the ballast bed and settling of the track is achieved. In order to control the track settlement, a levelling reference system composed of taut cables is employed.

Claim ES 2 030 362 shows a ballast bed consolidation machine which undertakes a controlled settling of the position of the track with regard to height from the current position to the theoretical position through the means of at least one of the following parameters of the stabilising unit: vertical load, vibration frequency or longitudinal speed. The levelling control consists of a levelling reference base and a measuring spoke with a height value transmitter, characterised by the inclusion of a measuring spoke placed behind the track stabilising unit(s) according to the direction of the machine's movement. This same claim also shows an advantageous improvement of the invention by which one or more measuring spokes are added, placed in front longitudinally according to the direction of the work. The aforesaid improvement allows the automatic compensation of errors observed in the height of the track, caused by the load exercised by the machine on areas that have not been levelled.

Claim AT-PS 380 280 shows a railway work machine in the form of a track tamping machine with a chassis of tools with tamping, lifting and alignment units situated at the fore according to the direction of work and equipped with stabilising units at the rear. Both units are complimented by various measurement mechanisms which allow the control of transversal movements of the track exercised by the alignment unit of the track tamping machine.

Until the present day, all railway maintenance processes that require the elevation of the track, or of some stretches of the track, are undertaken by machines equipped with at least one tamping unit. There is a wide variety of these machines or combinations of machines among which are found those detailed in the aforementioned claims. The inconvenient thing about working with tamping units is that it necessitates lifting more than the actual deviation to be corrected. What is more, in order to guarantee this lifting, additional ballast is required to spread on the ballast bed cross-section. The necessity of this additional material increases costs and the time required for the operation, which is usually carried out by at least one other machine capable of distributing and profiling the ballast bed cross-section again. The repetition of successive lifting processes with the addition of ballast on the same stretch causes the distance between the rail and the overhead catenary lines be reduced. Once the established limit for this distance is no longer met, the track is no longer apt for use. This phenomenon necessitates either the track being stripped down or the overhead catenary lines being raised.

Another disadvantage of currently available levelling and alignment machines which use tamping units to pack the sleepers is that they do not offer the possibility of measuring the compaction quality of the process or of correcting the errors thus identified. It is only later, during the process of stabilising that this disadvantage is detected.

There is also a technique in existence through which the ballast bed cross-section and the track are stabilised without exerting any force on the latter, but rather applying force only on the area of ballast between the sleepers. One machine capable of undertaking this work is that found in claim ES 2 169 279 T3. Detailed therein is an example of execution in which an electric train consists of a primary percussive unit, constituted by vibrating hydraulic tool parts which are supported by a frame in the form of the gantry crane of the car, and which can be arranged so that they are placed at either side of each sleeper and also at their ends.

With regard to the mode and method of employment of these machines for carrying out these processes of maintenance, which is also the object of the present invention, the technology currently in existence allows a choice between two options for correcting the track positioning, according to the lifting produced. The first option includes height correction with levelling through lifting to a high point. Here the stabilising process is preceded by a tamping process which leaves the track at a reference height, always greater than the maximum height registered for the corresponding rail. The second option included height correction with levelling to a low point and it is defined in the aforementioned claim AT-PS 345 881.

The methods and machines for railway maintenance available until the present work with theoretical or empirical limits for the capacity of each machine to modify the longitudinal profile of track, either through a process of lifting or lowering, but they do not take into account any magnitude corresponding to the actual state of the ballast bed. Neither do these methods include any type of control which relates the compaction level of the ballast bed with the desired levelling.

DESCRIPTION OF THE INVENTION

The invention at hand consists of an improvement to the current process of levelling, alignment and track stabilising and consolidation of the ballast bed, and a machine to undertake the aforesaid process in an efficient manner.

In summary, a machine with a series of working units capable of moving along the railway track has been conceived. The first working unit is denominated an additional lifting unit and is capable of manipulating the track's position to take it and pack it into the desired position prior to the stabilising process. To the rear, with regard to the machine's direction of work, is the stabilising unit, formed by two stabilising trolleys similar to those currently in existence, with the capacity to lower the position of the track to the theoretical profile in a controlled manner and improvising its stabilising through the application of vertical loads with a vibratory component on the track. The quality of the result of this process depends on various factors of the action in itself, such as the static and vibratory values of the load and the duration of its application. However, it also depends on the starting position of the track with regard to the theoretical profile and the degree of compaction of the ballast bed. The machine also counts with various elements typical to the technique of longitudinal and transversal deviation measurement in order to determine the position of the track at any given moment.

From this point forward, when referring to the machine and the process which are the object of this invention, the term "additional lifting" shall be employed to define the value of additional elevation to the theoretical track profile which is required by the stabilising units in order to reduce this magnitude to within the optimal stabilising load parameters established. The machine regulates this value with a feedback cycle and modifies the theoretical profile and/or the additional lifting when required as shall be detailed herein.

Firstly, we shall focus on the improvements with regard to the machine itself. The first of these is the conception of a machine which is capable of levelling the track, with or without lifting, without the use of tamping units, thus eliminating the necessity of adding new ballast, or necessitating the use of a minimum of new ballast. As has been expounded in the previous section, currently existing tamping technique has a number of disadvantages with regard to the duration of work, the cost of the process and the lifespan of the track. In its place the machine is equipped with what shall hereafter be referred to as the "additional lifting unit" which is composed of a compacting trolley and a lifting and aligning trolley.

The function of the lifting and alignment trolley is to position the track in the starting point for the optimal settlement which will later be produced by the stabilising unit. It has been conceived in a manner similar to that of those in current existence. It uses a pair of rollers which can be fixed to the railhead by the means of hydraulic actuations to pull it. The force required to lift the track is applied by the use of two cylinders in vertical position with the capacity to pivot from a fixed point on the chassis of the machine. Another pair of cylinders, fixed in horizontal position and also capable of pivoting from the chassis, modify the lateral position of the track.

The compacting trolley consists mainly of a frame on which some articulated wedge-shaped bodies denominated compactors are fixed. These compactors transmit the compacting charge to the ballast bed. The vertical load of the compacting trolley compacts the area of the ballast bed between at least two sleepers and its vibrating component causes a migration of the ballast to the area below the sleepers which are free of any vertical load. As the sleeper has been lifted with the track by the lifting and alignment trolley, a raising effect is caused in the level of the ballast below the sleeper until the former meets the latter. In order to be able to undertake its function correctly, the compacting trolley is situated immediately behind the lifting and alignment trolley. To obtain a better understanding of the structure and functioning of this trolley, please refer to the section of descriptions of the drawings.

As has been detailed earlier, the compacting process and subsequent raising of the ballast bed require the application of an oscillating vertical load on the same point for a certain period of time. Therefore, if continuous work without stopping the machine is desired, longitudinal movement in a relative manner between the additional lifting unit and the chassis of the machine is required. In order to achieve this, the unit is supported over the track by two wheels at the rear end and by guiding columns, which are fixed to the machine at the front end. The movement between the two bodies is controlled by a hydraulic cylinder. With the aim of lending the machine greater versatility, the additional lifting unit has been equipped with a system that allows relative longitudinal movement between the compacting trolley and the lifting and alignment trolley. In order to achieve this, these trolleys are joined by a telescopic system which is operated by a hydraulic cylinder.

Another significant improvement offered by this machine is that the cylinders which transmit force to the trolleys of the additional lifting unit pivot around a fixed point on the chassis of the machine, thus simplifying the structure of the unit.

Another characteristic feature of the invention of this machine is its use of a system to assess the real state of the infrastructure. In this case, the use of ground-penetrating radar has been opted for to measure and record the degree of ballast compaction. This improvement provides real data from which the limit values for acceptance of the quality of the process and the capacity of the machine can be calculated. Once the degree of compaction of the ballast has been established, the settlement required to guarantee a minimum degree of compaction at each point on the track can be determined. In turn, once the maximum load that can be applied by the stabilising units is also established, the maximum settlement that can be obtained by the machine can be calculated. Thus this invention adds to the technique currently in existence the possibility of establishing a coherent theoretical profile with the requirements of the infrastructure and the capacity of the machine.

The claims concerning the maintenance process are grounded in the improvements in the decision-making capacity of the machine with regard to obtaining optimal performance in its work. The characteristic of the machine to undertake theoretical calculations based on real variables of the infrastructure's condition, which are measured directly, has been explained earlier. These variables allow the most efficient theoretical profile of the track to be calculated with the certitude that this lies within the settlement capacity of the machine. This optimal profile is characterised by the fact that it is obtained through levelling without lifting or the addition of new ballast, or with the addition of the minimum possible amount. In the following sections are to be found a more detailed explanation of the directives adopted by the machine to determine and achieve the optimal track profile according to the different situations than can arise during the maintenance process.

It is evident that deviations can appear between the dimensions previously calculated and those obtained during the process of the machine's work. To compliment this improvement, and also the automatising of the track maintenance process, a control system has been designed which ensures that the load applied by the stabilising unit during the settlement of the track to the theoretical profile always remains within the established optimal range. In order to guarantee this control, the load required to place the track in its calculated position is recorded continuously. It must be taken into account that, due to the positioning of the work units on the machine, there is a stretch of the track that is yet to be stabilised, over which the additional lifting unit has already passed. This means that if a load value which is outside the optimal range is recorded on this stretch, it would no longer be possible to correct its starting position, which is used to establish its additional lifting value. In order to avoid the necessity of stopping and putting the machine into reverse, minimum and maximum threshold values are established which are more restrictive than both the established limits and those of the load limit of the machine. In this way, if the load value of the stabilising unit is below the minimum threshold, this means that the stabilising process is being carried out from a lower position than necessary, according to the degree of compaction present in this point in the track. To avoid arriving at a settlement which is not optimal, an additional lifting is exerted, or its value is increased as appropriate, at the next work point of the additional lifting unit. A closed-loop control is established to adjust this minimum required value in order to maintain the highest level of effectiveness possible. On the other hand, if the real load applied exceeds the maximum threshold, this means that the compacting process is being carried out from a position that is too high, according to the degree of compaction present in this point in the track. In order to avoid the error which would arise as a result of exceeding the established limit, the additional lifting value in the subsequent points is diminished. In the case that no additional lifting is being undertaken, it is necessary to elevate the theoretical track profile for the points which have not yet been treated. The passage from one profile to another is undertaken without the need to stop the machine and generates a smooth transition ramp. The control system, which has been detailed before, keeps a record of the corrections which have been necessary during the process in order to apply them in similar situations in the future. For a more exhaustive explanation of the flow of decisions taken by the machine, please refer to the section of the detailed explanation of a mode of operation of the invention and the decision flowchart of the machine (FIGS. 9 and 10).

DESCRIPTION OF THE DRAWINGS

To compliment the description which shall be made below, and with the aim of aiding a better understanding of the characteristics of the invention, in accordance with a preferred embodiment of the same, a set of drawings is included as an integral part of the aforesaid description.

They are of an illustrative and non-limiting nature and represent the following:

FIG. 9 corresponds to absolute maintenance work, which means to say that the machine knows beforehand the ultimate position in which the track should remain. FIG. 10 represents the flow in relative maintenance work and serves as a summary of FIGS. 4 and 7.

PREFERRED EMBODIMENT OF THE INVENTION

Figure 1:
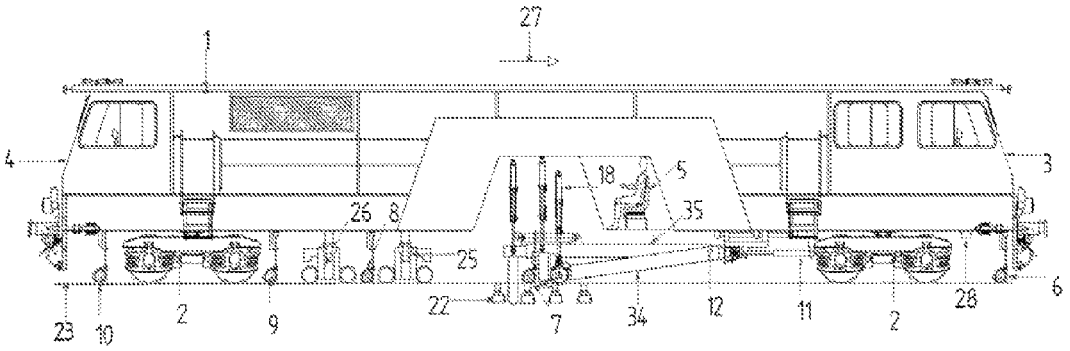
FIG. 1.—Shows a side view of a machine to level, align and stabilise the track and to compact the ballast bed made in accordance with the object of the present invention.

In view of the figures described, and more specifically FIG. 1, it can be observed that the machine which is here extolled (1) is comprised of two bogies with traction capacity (2), and three control cabins: one situated at the front (3), one at the rear (4) and one at the centre (5). There are two tensioner measuring trolleys, one at the rear (10) and one at the front (6). Numbers 7 and 9 correspond to the other three measuring trolleys. The machine has an additional lifting unit, which is represented in greater detail in FIG. 2, whose movement relative to the rest of the machine is controlled by the total longitudinal cylinder (11). The alignment cylinders (18) generate a transversal movement in order to cause the track alignment. To the rear of this unit, according to the direction of work (27), is found a stabilising unit formed by two stabilising trolleys (25 and 26). The ground-penetrating radar is situated at the front of the machine (28).

Therefore, the measurement system is comprised of five measurement trolleys (6, 7, 8, 9 and 10) and three measuring cables parallel to the machine's longitudinal axis and tautened between trolleys 6 and 10. The first measuring trolley, at the front (6), is situated at the fore of the machine in front of the front bogey (2), according to the direction of work. The second trolley (7) is integrated with the lifting and alignment trolley (34). The third trolley (8) is to be found between the two stabilising trolleys (25 and 26). The fourth measuring trolley (9) is located between the stabilising trolley (26) and the rear bogey (2). The last trolley (10) is situated behind the machine's rear bogey according to the direction of work. The position of the three measuring cables is as follows: 1 central cable used to measure the track alignment and two external cables, one for each rail and with the purpose of measuring their levelling. In order to carry out the process of measuring, each measuring trolley (6, 7, 8, 9 and 10) is equipped with the corresponding sensors. The machine records the levelling deflection in each cable as also the alignment deflection. During the work process, the rail cant is recorded with the trolley (6) and the degree of compaction of the ballast bed (24) with the ground-penetrating radar (28).

Figure 2:
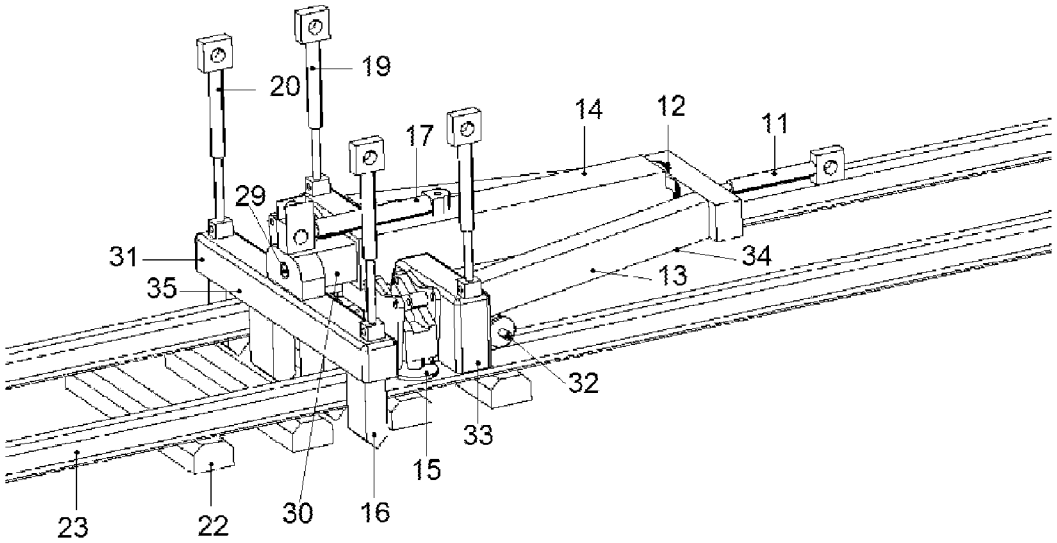
FIG. 2.—Shows a detail in perspective of the additional lifting unit which forms part of the machine from the previous figure.

More specifically, and in accordance with FIG. 2, the additional lifting unit consists of two trolleys, the compacting trolley (35) and the lifting and alignment trolley (34). The compacting trolley (35) is comprised of a main frame which is composed of two beams, one transversal (31) and another that is telescopic and longitudinal, with one sliding beam (30) within another fixed one (14). The relative movement between these two beams is controlled by the partial longitudinal cylinder (17). The compacting cylinders (20) are located symmetrically with regard to the longitudinal axis of the track, attached to the chassis of the machine at the top end and to the trolley frame (31) at the bottom end. These cylinders govern the rising and falling movement of the trolley and exert the vertical load during compaction. The oscillating load is exerted by a vibration actuator (29) situated in the main frame of the trolley. The compactors (16) are composed of four bodies that are articulated and joined to the frame (31). Its form adapts itself to the area between the track sleepers (22), saving the area occupied by the rail (23). The frame of the lifting and alignment trolley (34) is composed of one main transversal body (33) and one longitudinal (13). Under this are attached two wheels (32) which allow it to pass along the rails of the track (23). The lifting cylinders (19) are situated symmetrically with respect to the longitudinal axis of the track, connected to the machine's chassis at the upper end and to the trolley frame (33) at the bottom. Two sets of lifting rollers (15) are connected to the frame body of the trolley, one for each rail. They can be closed onto the railhead (23) and limit the relative movement between these bodies on the track's transversal plane. The compacting trolley and the lifting and alignment trolley are joined by a ball and socket joint (12). The displacement which exists between these trolleys and the machine's chassis is controlled by the total longitudinal cylinder (11).

Figure 3A:
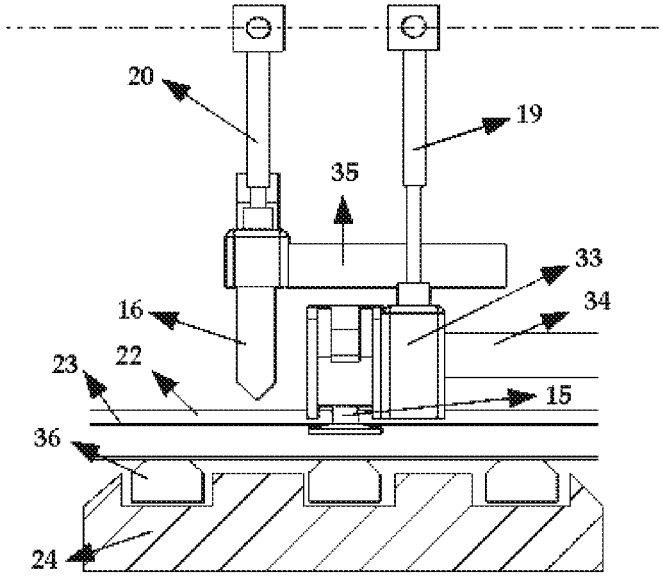
FIGS. 3A-3D —show in sequence the phases or working operations of the additional lifting unit in the case that there is no relative movement between the compacting trolley and the lifting and alignment trolley.
Figure 3B:
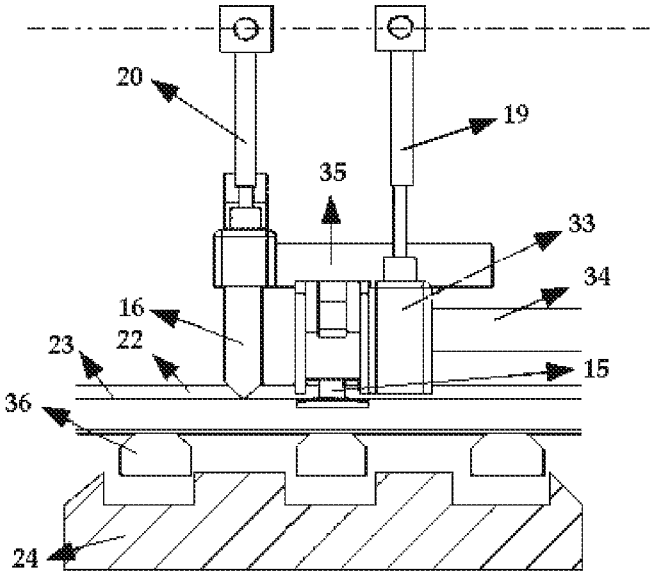
Figure 3C:
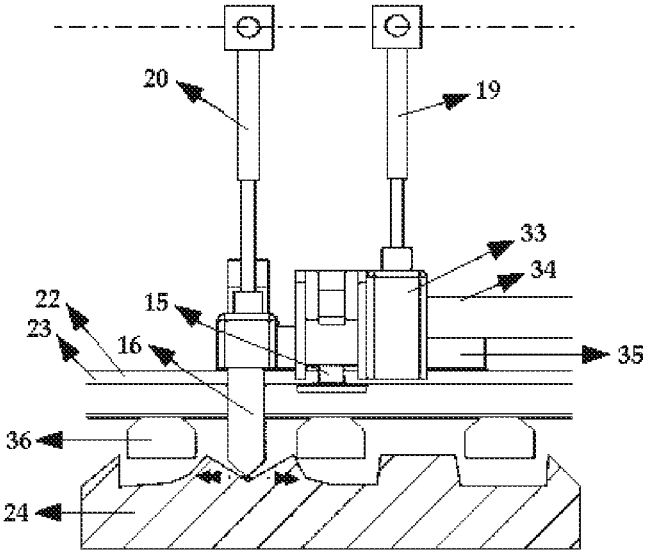
Figure 3D:
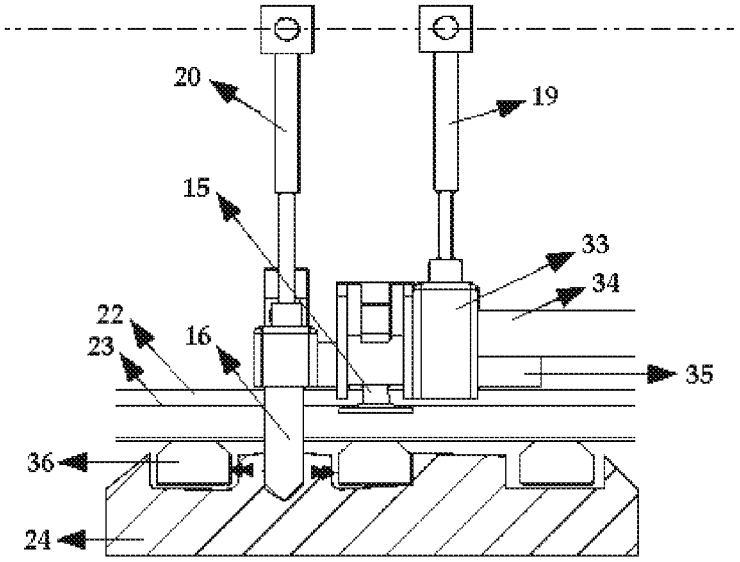

As has been mentioned before, in FIGS. 3A-3D a work sequence of the additional lifting unit is represented showing the case in which there is no relative movement between the compacting trolley (35) and the lifting and alignment trolley (34). In the first step, as shown in FIG. 3A, the lifting and alignment trolley is situated in such a way that the compactors (16) are located in the space between the sleepers (36 and 22). The rollers (15) latch onto the railhead (23). In FIG. 3B the track (23) is placed in the desired position through the action of the lifting cylinder (19) on the beam of the trolley frame (33). In this figure only the variation in track (23) height can be seen, but but alignment is also carried out according to the transversal direction. In FIG. 3C the compacting trolley is lowered so that the compactors (16) exert pressure on the ballast bed (24). Once the track has been placed in the desired position, as shown in FIG. 3D, the process is then completed, lifting the compacting trolley (35) and moving the additional lifting unit forward to the next area between sleepers.

Two cases of functioning can be identified for the lifting and alignment trolley (34) and the compacting trolley (35), according to the value of additional lifting required by the track at each work point: (hereafter, we shall use the abbreviations CT for the compacting trolley and LAT for the lifting and alignment trolley).

Option 1) Lifting Superior to 10 mm:

The maintenance process is undertaken with an uninterrupted longitudinal displacement of the machine (1) along the track (23). In this case there is no relative movement in the longitudinal direction between the LAT (34) and the CT (35). The corresponding work cycle is as follows:

a) displacement of the LAT (34) to its most frontal position with regard to the machine (1)
b) The fixing rollers (15) latch onto the railhead.
c) Actuation of the total longitudinal positioning cylinder (11), in such a manner that the speed of the LAT (34) and the CT (35) with regard to the rail is non-existent, while the rest of the machine continues its advance.
d) The track lifting and alignment (23) to the position desired at this point is undertaken simultaneously with step c).
e) Simultaneously with step c), the CT (35) descends, applying the vertical oscillating force to the area of the ballast bed (24) between the sleepers (22). The application of this force causes the ballast to move into the load-free areas, in this case the area beneath the sleepers. This situation is sustained for the time necessary in order to place the track in its new position. In the case that it be necessary, the speed of advancement of the rest of the machine adapts to the time required for this process.
f) once processes d) and e) have been completed, the fixing rollers open and the CT is lifted (35).
g) return to point a), where the CT (35) and the LAT (34) move forward to their most frontal position through the employment of the cylinder (11).

Option 2) Lifting Inferior to 10 mm:

The process is similar to that explained in option 1, except there is only relative displacement between the CT (35) and the rest of the machine (1), the LAT (34) moving the machine's chassis jointly. The track (23) is held in suspension throughout the process. Thus the corresponding work cycle is:

a) displacement of the CT (35) and the LAT (34) to their most frontal position.

Therefore both the partial (17) and the total (11) longitudinal positioning cylinders are raised.

b) Actuation of the partial longitudinal positioning cylinder (17), in such a manner that the speed of the CT (35) with regard to the track is non-existent, while the rest of the machine continues its advance.
c) Simultaneously with step b), the CT (35) descends applying the vertical oscillating force to the area of ballast bed (24) between the sleepers (22). The application of this force causes the ballast to move to the load-free areas, in this case the area beneath the sleepers. This situation is maintained for the time necessary in order to place the track in its new position. In the case that it be necessary, the speed of advancement of the rest of the machine adapts to the time required for this process.

d) once processes b) and c) have been completed the CT is lifted.

e) return to point a) where the CT (35) moves to its most frontal position through the employment of the cylinder (17).

Figure 4:
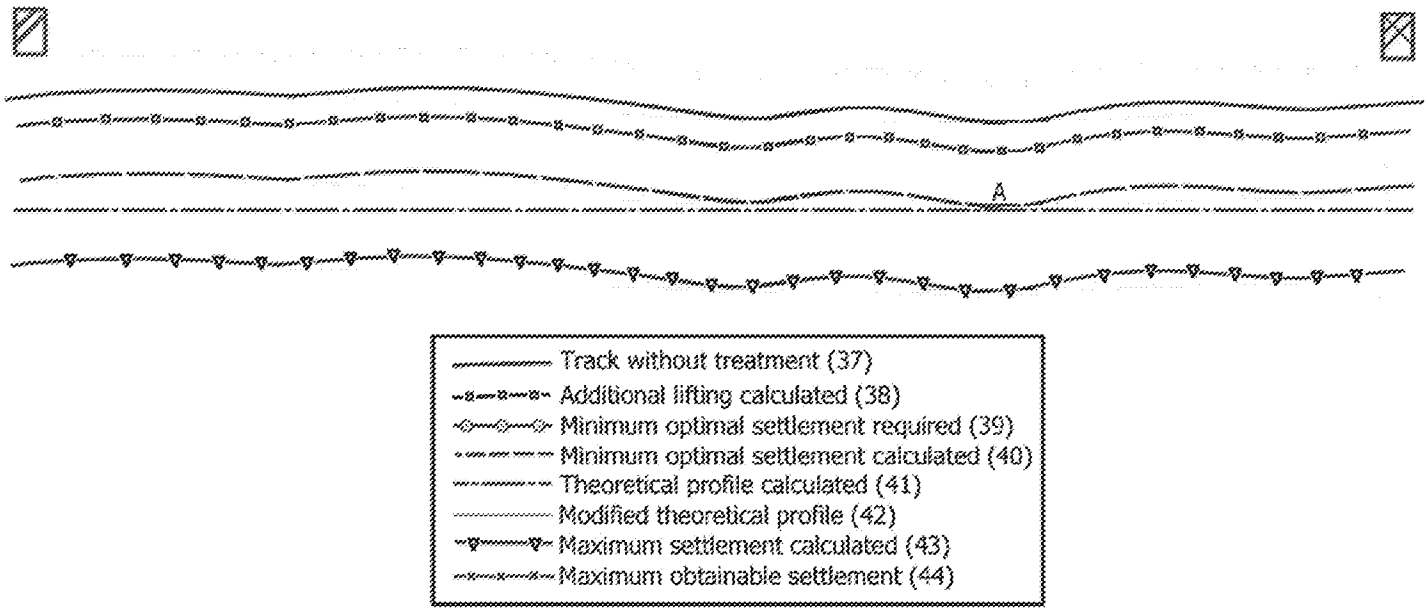
FIG. 4.—Shows the track profiles, as also other variables calculated for the machine such as the track profile without treatment, the minimum optimal settlement profile calculated, the theoretical profile extrapolated from that point, the maximum settlement calculated in relation to the maximum capacity of the machine at each point and the additional lifting calculated corresponding to the theoretical profile calculated in the ideal case in which the machine has the capacity to lower all the track to the theoretical profile calculated. What is more, the track without treatment always falls above the additional lifting calculated and thus lifting the track is not necessary under any circumstances.
Figure 7:
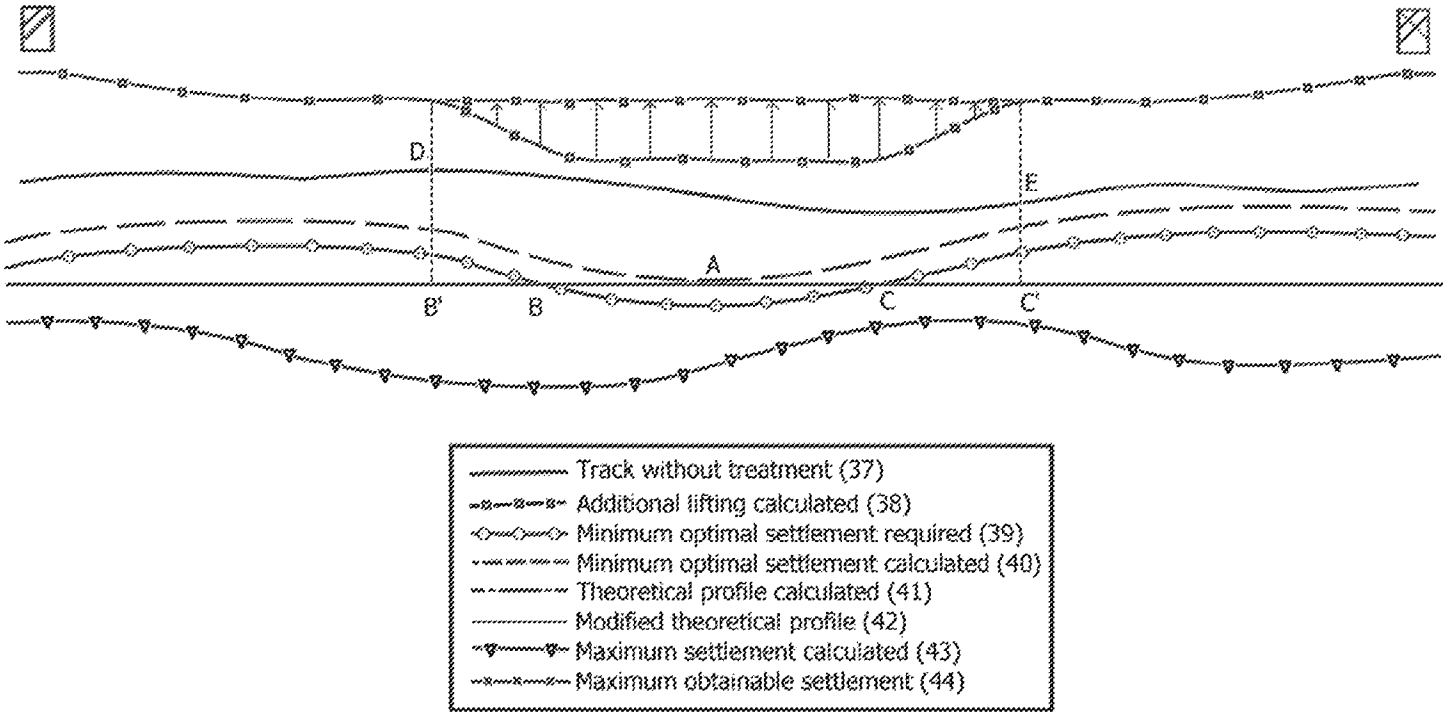

The content of FIGS. 4 and 7 shall now be analysed. Here are represented the profiles of the track and the values calculated by the machine for four possible scenarios in relative maintenance work, that is to say work without any prior data. For all four, one common first stage can be defined. In this stage, firstly a record is taken of the "track without treatment" (37) Subsequently, the machine generates the profile of the "minimum optimal settlement calculated" (40), whose lowest point is A, and establishes a "theoretical profile calculated" (41) according to that point. The "maximum settlement calculated" (43) is then also established in relation to the maximum capacity of the machine at each point and the "additional lifting calculated" corresponding to the "theoretical profile calculated".

For the sake of simplicity, in the drawings a horizontal and straight profile has always been used, but this reasoning can be extrapolated to stretches with irregularities or unevenness. Also, the variations in height of the "track without treatment" (37) have been exaggerated to facilitate understanding of the machine's decision-making process.

More specifically, in FIG. 4 the ideal case is represented (case 1.*a*) in which the machine has the capacity to lower all the track to the "theoretical profile calculated" (41) and furthermore the track without treatment is always above the "additional lifting calculated" (38). Therefore no lifting of the track shall be necessary whatsoever.

Figure 5:
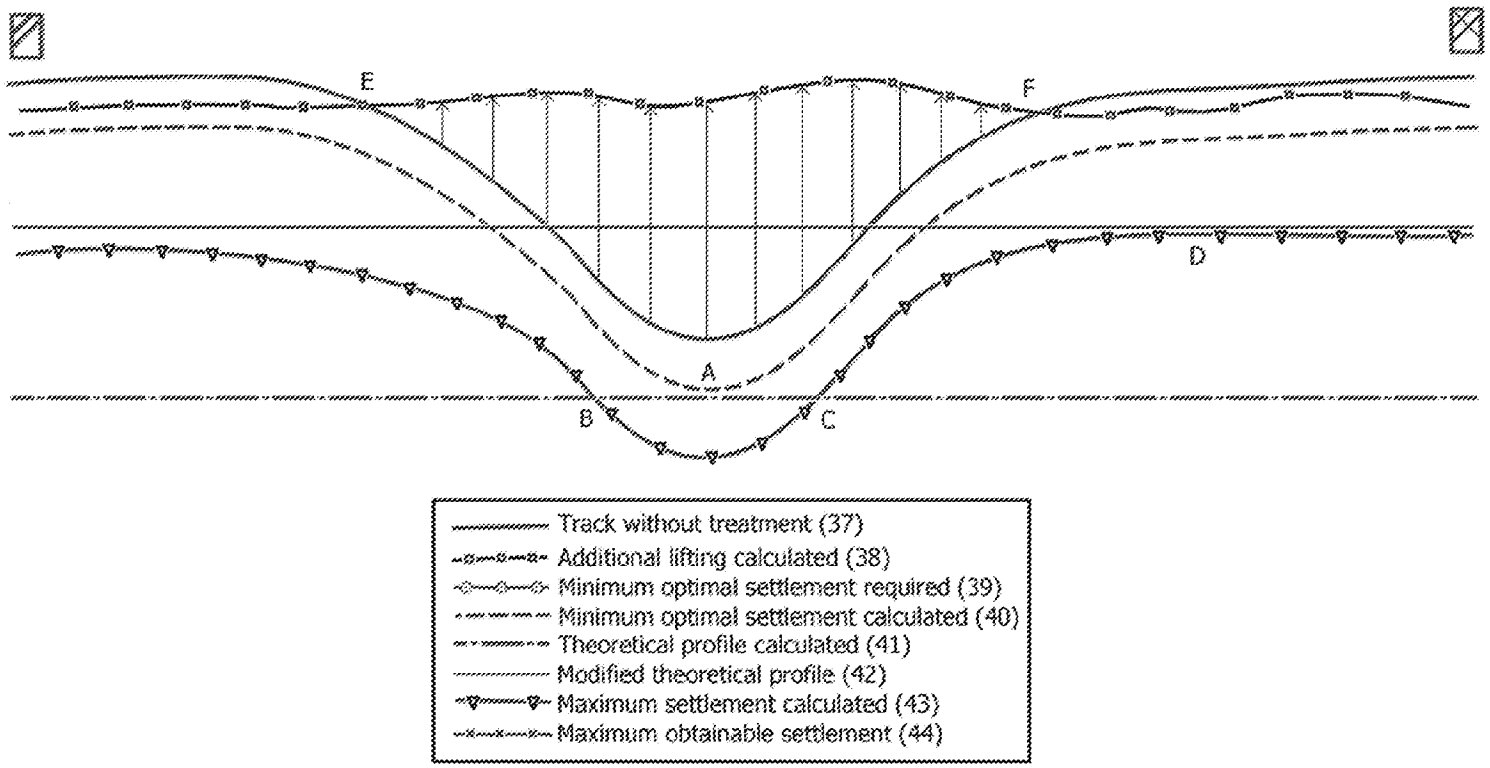
FIG. 5.—Shows a graph similar to that of FIG. 4, but corresponding to the case in which there is not the capacity to settle the track to the theoretical profile calculated, necessitating a modification of the same (the theoretical profile is modified).

On the other hand, FIG. 5 represents case 1.*b*, in which the machine does not have the capacity to settle the track to the "theoretical profile calculated" (41), as it falls below the "maximum settlement calculated" (43) on some stretch. In this case, the phenomenon occurs from the beginning of the stretch until point B and from C until the end. The machine generates the "modified theoretical profile" (42) according to point D, which corresponds to the highest point of the "maximum settlement calculated" (43). Also, the "additional lifting calculated" (38) is regenerated. According to these profiles, the machine will commence the work process with only settlement and alignment until its arrival at point E, where the "track without treatment" (37) requires additional lifting. Therefore, throughout the course of stretch E-F the machine enacts additional lifting before stabilising.

Figure 6:
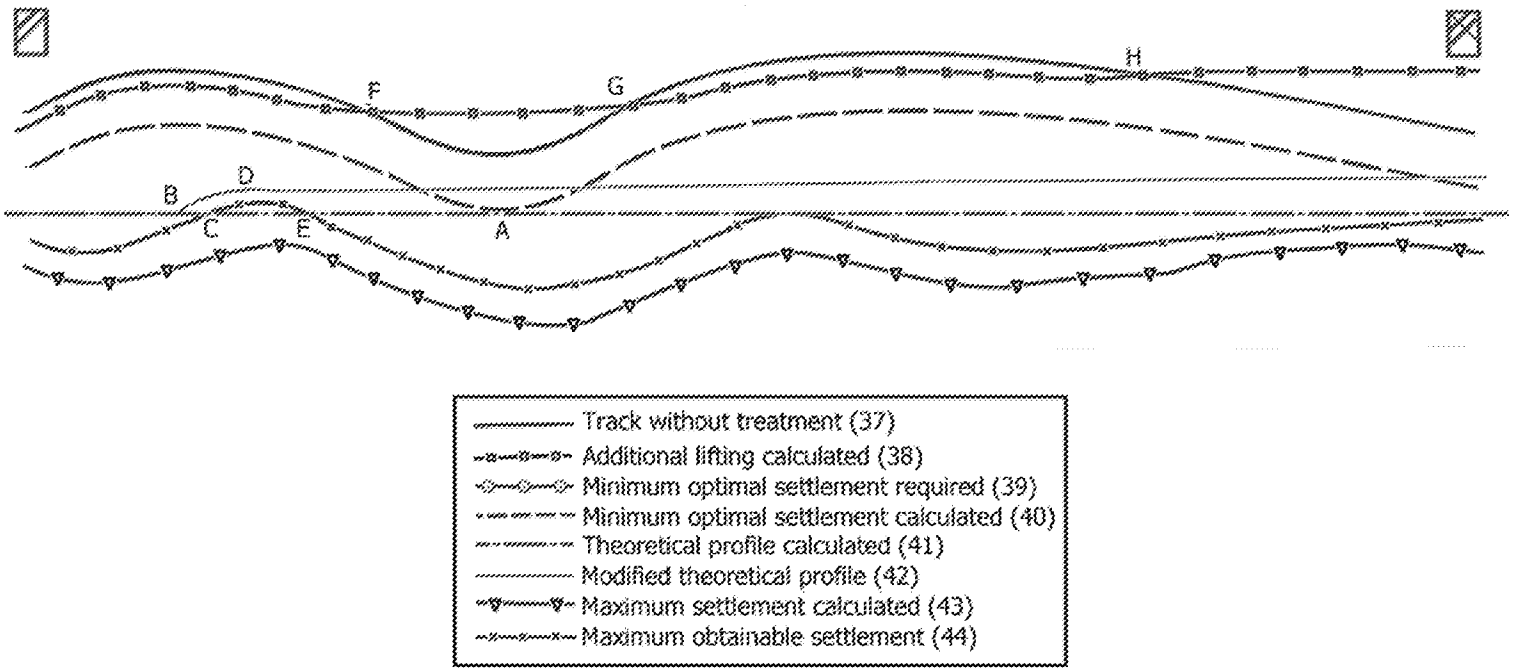
FIGS. 6 and 7.—Show line graphs similar to those in FIG. 4, in which is represented the way in which the machine acts when faced with a deviation between the values previously calculated and those which are obtained in real time during the machine's operation. More specifically, in FIG. 6 a case is represented where the real settlement capacity of the machine is less than that calculated, whereas in FIG. 7 a situation is represented in which the necessary minimum optimal settlement is greater than that calculated.

FIGS. 6 and 7 represent how the machine acts when faced with a deviation between the values previously calculated and those that are obtained in real time during work. In FIG. 6 an analogous case to case 1.*a*.1 is represented, in which the real settlement capacity of the machine is less than that calculated. As a consequence of this, it can occur that the "maximum obtainable settlement" (44) exceeds the "theoretical profile calculated" (41) (stretch C-E). The machine anticipates this problem and generates the "modified theoretical profile" (42) with a transition ramp B-D. This modification of the profile can lead to a case similar to that of FIG. 5, where it would be necessary to use additional lifting in stretch F-G and from H until the end.

More specifically, FIG. 7 represents a situation in which the "minimum optimal settlement required" (39) is greater than the "calculated" (40), analogous to case 1.*a*.2. In this case, stretch B-C would be reached, where the "theoretical profile" (41=42) exceeds the "minimum optimal settlement required" (39). The machine avoids this error increasing as necessary the value of the "additional lifting calculated" (38) in stretch B'-C'.

Figure 8:
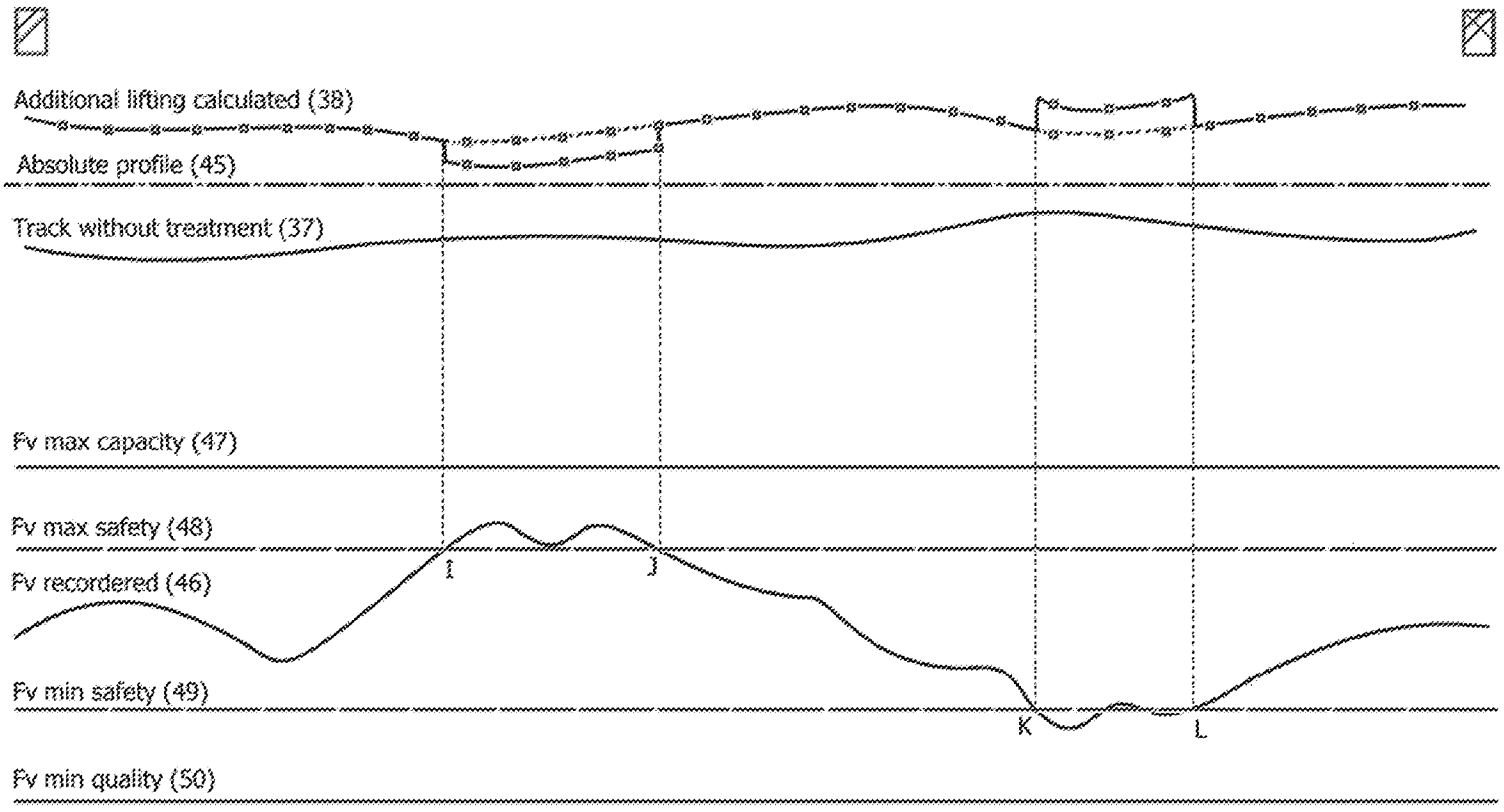
FIG. 8.—Shows a graph similar to that in FIGS. 4 and 7, but corresponding to a track maintenance or construction process with absolute values, where the machine receives absolute profile data.

FIG. 8 represents an absolute process of track maintenance or construction in which the machine receives the "absolute profile" (45) data. The machine begins to work with calculated additional lifting (38) according to the data from the ground-penetrating radar, controlling the value of the vertical load recorded in the stabilising unit (46). In the case that this should exceed the established superior or inferior safety limits to achieve optimal compaction (48 and 49), the additional lifting calculated (38) is modified in the stretches I-J and K-L. In this way it is ensured that the machine does not exceed its maximum capacity (47) nor the minimum permitted value for compaction quality (50).

Figure 9:
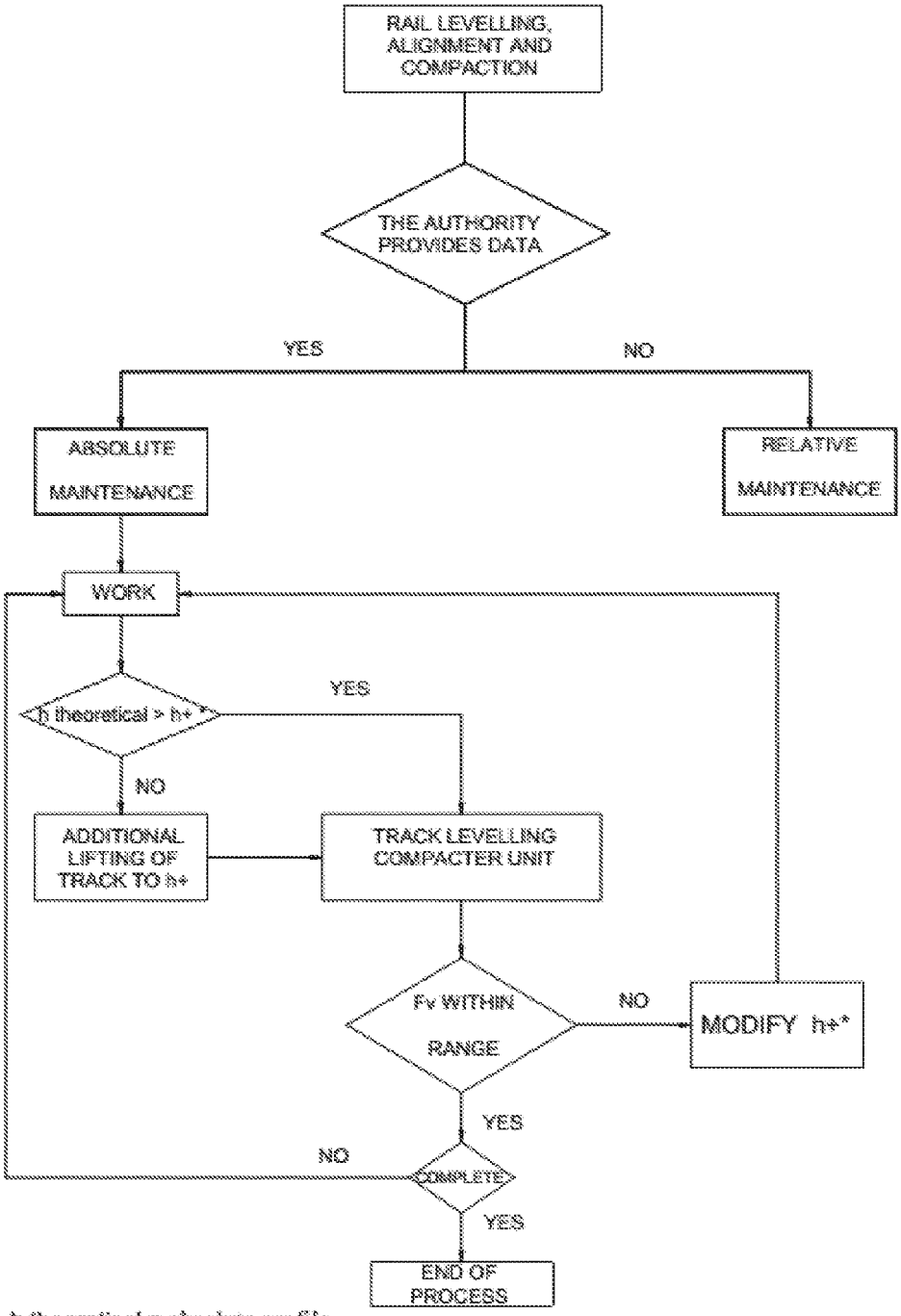
FIGS. 9 and 10.—Both represent diagrams of the decision making of the machine during the work process.
Figure 10:
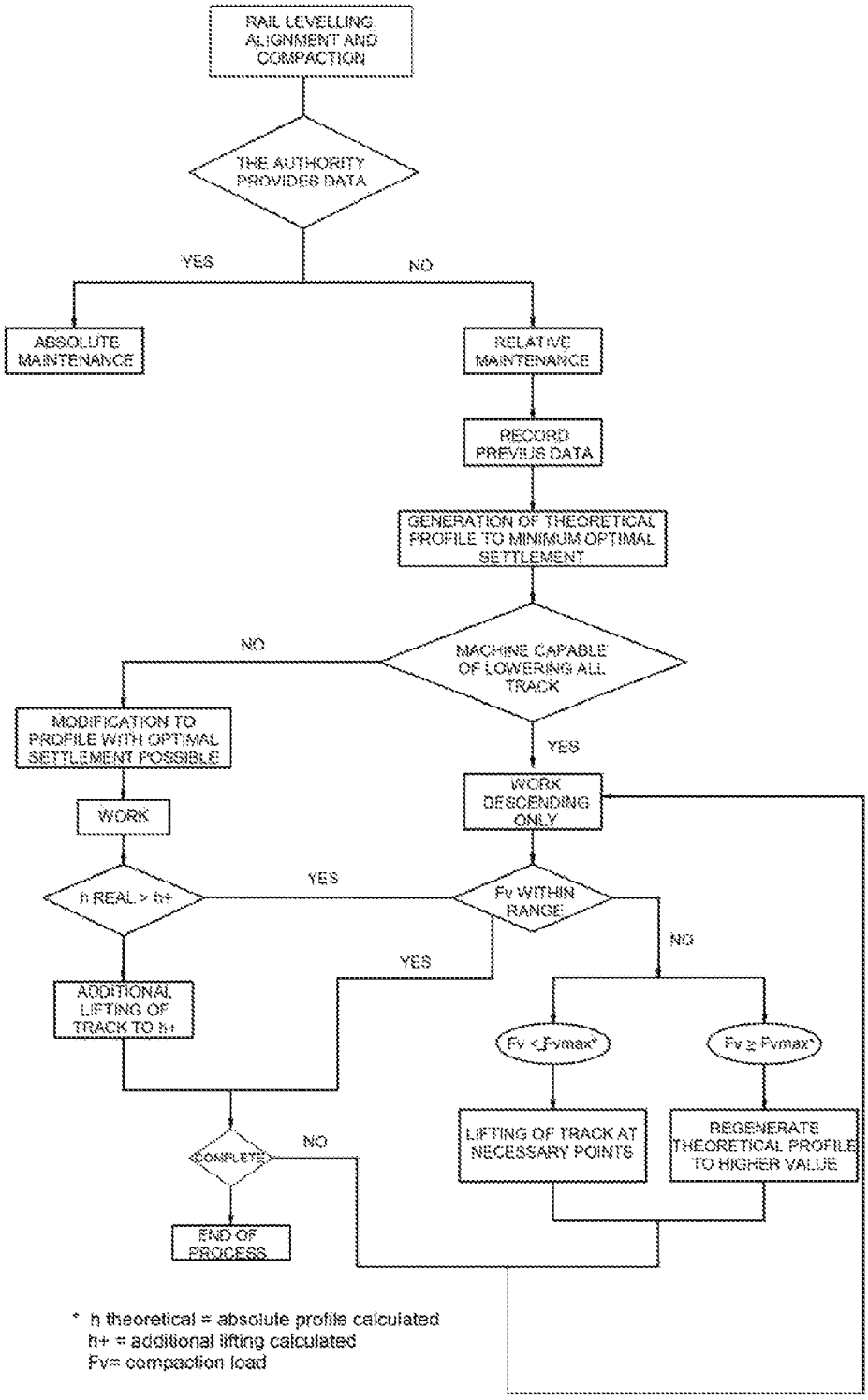

FIGS. 9 and 10 represent the machine's decision-making flowchart during work. FIG. 9 corresponds to absolute maintenance work, that is to say the machine knows the position in which the track must be placed beforehand. FIG. 10 represents the flowchart in relative maintenance work and serves as a summary of FIGS. 4 to 7.

Therefore, from these figures the following cases of work can be seen:

1) Relative Track Maintenance.

The maintenance process includes the optimisation of track geometry without the assistance of data on the theoretical profile from the entity responsible for its maintenance. Therefore, the first necessary step is to determine the optimal theoretical profile to which the track is to be levelled and which complies with the quality requirements stipulated by the corresponding authority. For all of these cases a common first stage can be defined where the machine, at a speed of up to 30 km/h, records the longitudinal and transversal deviations of both rails of the "track without treatment" (37) in an independent fashion, as also the real degree of compaction of the ballast bed.

With this data the height at which the track must be positioned in order to achieve an optimal stabilisation value is calculated. This is proportional to the degree of compaction of the ballast bed. The union of all these points generates the profile of the "minimum optimal settlement calculated" (40). The lower the values of lifting applied to the track are, the more efficient the process is, as no addition of ballast is required and the position of the track with regard to the overhead catenary lines is not modified. In this manner, a theoretical profile which does not require lifting at any point is sought. Given the definition of "minimum optimal settlement calculated" (40), any theoretical profile which falls below this will comply with the minimum quality requirement for the stabilising load applied. In order to avoid the loss of efficiency when working, the "theoretical profile calculated" (41) is established according to the lowest point of the minimum optimal settlement calculated" (point A). At the same time, calculations are made, point by point, for the maximum settlement that can be achieved by the machine according to the degree of compaction of the ballast bed and the technical characteristics of the machine itself (working pressure and the dimensions of the stabilising load cylinders). The union of these values generates the "maximum settlement calculated" (43). After a point by point comparison between this magnitude and the theoretical profile calculated (41), the machine determines whether it has the capacity to lower the track to this gradient. This entails two possible scenarios:

1.a) (see FIG. 4) In this case, the machine has determined that it does have the capacity to perform settlement to the theoretical profile calculated (41) along all the stretch and this shall be carried out without lifting the track. The process of track maintenance is commenced in which the additional lifting unit performs only alignment, while the stabilising trolleys (25 and 26) level the track, settling it into the required position. The machine records the vertical load values applied by the stabilising trolleys (25 and 26) at all times. In order to ensure that this value complies with the maximum capacity (47, FIG. 8) and minimum quality (50, FIG. 8) limits, the system establishes maximum and minimum safety values (48 and 49, FIG. 8) which are more restrictive than the former. These safety values are used by the machine as threshold values to elevate the theoretical profile calculated (case 1.a.1) or to carry out additional lifting so that the force applied by the stabilising unit returns to values within the permitted range (case 1.a.2). These modifications are carried out automatically and without the necessity of interrupting the work cycle.

1.a.1) (see FIG. 6) It can occur that the real capacity of the machine—"maximum obtainable settlement" (44)—, falls below the "maximum settlement calculated" (43). The machine could reach a state of being incapable of leaving the track in the "theoretical profile calculated" (41, stretch C-E) Before reaching point C, the value of the load applied by the stabilising units exceeds the established maximum safety threshold (point B). In this moment the machine generates the "modified theoretical profile" (42) to a superior height for the stretch of track that has not yet been stabilised. The transition to this new profile is undertaken with an inclination within the limit values for variations in gradient and maximum gradient established by the body responsible for track maintenance. This inclination is sustained until the load value returns to within the maximum safety threshold (stretch B-D).

Upon levelling according to the "modified theoretical profile" (42), it is possible that in the stretch of track that is yet to be treated (37) there are points which either fall below the new profile, or which do not yet have sufficient additional lifting to reach an optimal level of stabilising (stretch F- and from H until the end). In this case, the machine proceeds as shall be seen in the following point.

1.a.2) (see FIG. 7) In the case that the "minimum settlement necessary" (39) is greater than the calculated (40), a state could arise in which the minimum compaction required by the administration is not ensured (stretch B-C). Before reaching point B, the value of the load applied by the stabilising units falls below the established safety minimum (B'). In this moment the "additional lifting calculated" (38) is modified as indicated in the figure. This value increases progressively until the load returns to within the minimum safety threshold. Once within the threshold, the value of the calculated additional lifting decreases progressively, providing the stabilising load remains above the minimum threshold. Thus a control cycle is established which ensures that the lifting applied to the track by the additional lifting unit be the minimum possible, preferably non-existent, and that the settlement to the theoretical (41) or modified (42) profile be optimal.

2) Absolute Track Maintenance (See FIGS. 8 and 9)
In this second case, the entity responsible for track maintenance gives the absolute profile (45) of where the track is to be placed. This absolute profile is always above that of the track without treatment (37). In order to level the track to the absolute profile (45), with an optimal degree of compaction, it must be lifted to a higher position before settlement. This value is obtained from the additional lifting calculated (38), which is determined according to the data provided by the ground-penetrating radar and the magnitude of the lifting.

Once the theoretical data has been obtained, the work process is commenced and the values of the vertical load applied by the stabilising units (25 and 26) are recorded. In order to ensure that the value does not exceed the maximum capacity (47, FIG. 8) and minimum quality (50, FIG. 8) limits, the system establishes maximum and minimum safety values (48 and 49, FIG. 8) which are more restrictive than the former. These safety values are used by the machine as threshold values to reduce (stretch I-J, FIG. 8) or increase (stretch K-L) the additional lifting calculated (38), analogously in cases 1.a.1) and 1.a.2), detailed earlier.

The invention claimed is:

1. Railway maintenance machine for track levelling, alignment, compaction and stabilisation while advancing along a track, the machine comprising:

a chassis;

a ground-penetrating radar placed to capture a degree of compaction of an area of ballast bed below said ground-penetrating radar;

a lifting unit configured to position and pack the track into a required position, the lifting unit comprising a lifting and alignment trolley equipped with rollers, the rollers latching onto a railhead through the use of a series of actuations, the trolley having displacement wheels under the lifting and alignment trolley, which wheels allow displacement of the lifting and alignment trolley along the rails in the longitudinal direction of the track;

a first series of actuators being articulated and connected to fixed points on the chassis and on the lifting and alignment trolley, the actuators configured to move the track into a required position in both a vertical and horizontal direction in respect of a track transversal plane;

a compacting trolley equipped with wedge-shaped bodies;

a second series of actuators, articulated to fixed points of the chassis and of the compacting trolley, the actuators of said second series configured to displace the wedge-shaped bodies over the ballast bed and also to apply a vertical load to the ballast bed;

a vertical load actuator situated on a frame of the compacting trolley, the vertical load actuator comprising eccentric rotary bodies configured to generate an oscillating component in the vertical load applied to the ballast bed;

a third series of actuators configured for relative longitudinal movement between the lifting and alignment trolley and the compacting trolley;

a fourth series of actuators configured for relative longitudinal movement between the additional lifting unit and the chassis;

a stabilising unit equipped with stabilising trolleys to settle the track into the required position, said stabilising trolleys respectively comprising a frame equipped with rollers that latch onto rails through the use of a series of actuators;

a measurement arrangement to measure geometric parameters of the track, comprising five measuring trolleys a first at a front of the machine and in front of the ground-penetrating radar; a second between the lifting and alignment trolley and the compacting trolley; a third between the two trolleys of the stabilising unit; a fourth behind the stabilising trolley and in front of a rear bogie; and a fifth being situated behind the rear bogie.

2. The machine of claim 1, wherein said stabilizing trolleys further comprise:

A series of actuators, fixed to the machine's chassis and the compacting trolley, which apply a vertical load, which can be adjusted between 0 and 400 kN, to the track;

An actuator situated on the frame of the stabilising trolley which is equipped with eccentric rotary bodies which generate an oscillating component in the load applied to the track of a frequency variable between 30 and 45 hz.

3. Railway maintenance method for track levelling, alignment, compaction and stabilisation at locations while advancing along a track, characterised by:

I—a continuous advance along said track;

II—recording a degree of compaction of a ballast bed using a ground-penetrating radar;

III—lifting and aligning the track in a position with an elevation determined to achieve a required absolute profile; and adding to said determined elevation a lifting value, said lifting value equaling a settling value corresponding to settling caused by a stabilising unit on a subsequent passage over a current location, said lifting value being directly proportional to a factor determined by a required lifting and a degree of compaction previously recorded;

IV—exerting an oscillating vertical force on a ballast bed between sleepers using a compacting trolley and thereby moving excess ballast to an area below the sleepers, thus packing the track;

V—verifying and controlling a track position at said location

VI—causing the track to stably settle to a theoretical profile

VIIa—In the case that a vertical load applied is less than a predetermined minimum value, a proportionality factor for said lifting value for locations situated after the present location is increased;

VIIb—In the case that the vertical load applied exceeds a predetermined maximum value, the proportionality factor for said lifting value for locations situated after the present location is reduced.

4. The method of claim 3, wherein said exerting an oscillating vertical force and said measuring comprise actuating a first cylinder in such a way that the compacting trolley remains stationary with respect to the track, while the rest of the machine advances in a continuous manner.

5. The method of claim 4, wherein the lifting is over an extent greater than 10 mm, the first cylinder remaining stationary and raised and a second cylinder being actuated in such a manner that the lifting and alignment trolley remains stationary with respect to the track, while the rest of the machine advances in a continuous manner.

6. The method of claim 3, further comprising moving all of said trolleys to respective forwardmost positions with respect to said machines once a present section of track has been packed, in anticipation of a next work point.

7. The method of claim 3, comprising continually recording a value of a vertical load required to move the track into a desired position.

8. The method of claim 7, wherein said minimum value is selected to be more restrictive than a minimum degree of compaction permitted, and said maximum value is selected to be lower than a capacity of the stabiliser.

9. Railway maintenance method for track levelling, alignment, compaction and stabilisation the method comprising:

I—calculating a theoretical profile;

passing a first time over a stretch to be treated, said passing being carried out at a speed of up to 30 km/h and recording, point by point:

a degree of compaction of the ballast bed, said degree of compaction being determined using ground-penetrating radar; and longitudinal and transversal deviations of each of two rails of a track and a cant of the track;

II—calculating an amount of settling required at each point in the stretch so that a load applied is equal to a minimum predetermined value, said amount of settling being proportional to a degree of compaction previously recorded, a combination of amounts at successive points along said stretch generating a profile of a minimum optimal settling;

III—modifying the theoretical profile for the track based on a lowest point of the minimum optimal settling commencing a maintenance process as follows:

IV—continually advancing a maintenance location along said track;

V—transversally repositioning the Track without lifting;

VI—causing the track to settle to the theoretical profile;

VIIa—if the load falls below a minimum predetermined threshold, increasing lifting values for further points along said stretch VIIIa—if the load is below the minimum safety threshold then progressively increasing said lifting value until the load is within the minimum safety threshold;

IXa—if the load is within the threshold, then progressively reducing the additional lifting value as long as the load remains above the minimum threshold;

VIIb—if the load exceeds the maximum threshold, then reducing said lifting value;

VIIIb—if the load exceeds the maximum threshold, and the additional lifting value is zero, then modifying the theoretical profile using a smooth inclination from a preceding point with a gradient that is lower than a maximum gradient allowed, sustaining said inclination until a value of the stabilising load returns to below the maximum threshold, and providing a smooth exit inclination to the modified theoretical profile.

10. The method of claim 9, wherein said increasing said lifting value when said load is below said threshold value comprises positioning the track at said current location and exerting an oscillating vertical force on a ballast bed between sleepers, thereby to compact the ballast bed.

11. The method of claim 10, said compacting causing excess ballast to be moved to an area below the sleepers, the method comprising verifying and controlling a position of the track following said moving.

12. The method of claim 11, wherein said control comprises actuating a cylinder to operate a compacting trolley to remain stationary with respect to said track, while advancing in a continuous manner.

13. The method of claim 12, the lifting applied being above 10 mm.

* * * * *